United States Patent [19]

Mowbray

[11] 4,224,903

[45] Sep. 30, 1980

[54] FUEL SYSTEMS FOR INTERNAL COMBUSTION ENGINES

[75] Inventor: Dorian F. Mowbray, Burnham, England

[73] Assignee: Lucas Industries Limited, Birmingham, England

[21] Appl. No.: 8,963

[22] Filed: Feb. 2, 1979

[30] Foreign Application Priority Data

Mar. 21, 1978 [GB] United Kingdom ..... 11044/78

[51] Int. Cl.[3] ..... F02B 3/00; F02M 41/00; F04B 23/04

[52] U.S. Cl. ..... 123/300; 123/506; 417/251; 417/462; 239/124; 239/95

[58] Field of Search ..... 123/32 G, 32 F, 139 AN, 123/139 AT; 417/462, 251; 239/124, 125, 93, 95

[56] References Cited

U.S. PATENT DOCUMENTS

| | | | |
|---|---|---|---|
| 2,739,645 | 3/1956 | Voit | 123/139 AN |
| 3,391,871 | 7/1968 | Fleischer | 123/32 G |
| 3,394,891 | 7/1968 | Voit | 123/32 G |

FOREIGN PATENT DOCUMENTS

| | | | |
|---|---|---|---|
| 1284687 | 12/1968 | Fed. Rep. of Germany | 123/32 G |
| 1576478 | 1/1970 | Fed. Rep. of Germany | 123/32 G |
| 607554 | 8/1960 | Italy | 123/139 AT |
| 237487 | 7/1969 | U.S.S.R. | 417/462 |
| 266468 | 7/1970 | U.S.S.R. | 417/462 |

*Primary Examiner*—Charles J. Myhre
*Assistant Examiner*—Carl Stuart Miller

[57] ABSTRACT

A fuel system for a multi-cylinder engine comprises a plurality of injection nozzles mounted on an engine to direct fuel into respective combustion spaces of the engine. Each nozzle incorporates a resiliently loaded pressure actuated valve member which controls the flow of fuel through an outlet from a fuel inlet. A fuel pump is provided for supplying fuel to the inlets in turn. Pilot pumps incorporated in the nozzles respectively cause a small volume of fuel to be delivered through the respective outlets in advance of the main volume of fuel. Pilot inlets on the injection nozzles respectively receive liquid under pressure in turn to actuate the respective pilot pumps and each nozzle incorporates a non-return valve disposed to allow fuel which has leaked past the respective valve member to flow to the respective pilot inlet when the liuid pressure at the pilot inlet is sufficiently low the system including a pressure pump for supplying liquid under pressure to the pilot inlets in turn and means for connecting the pilot inlets to a drain during at least part of the time when liquid is not being delivered thereto whereby the fuel which has leaked past the valve members can flow by way of said non-return valves to the drain.

7 Claims, 1 Drawing Figure

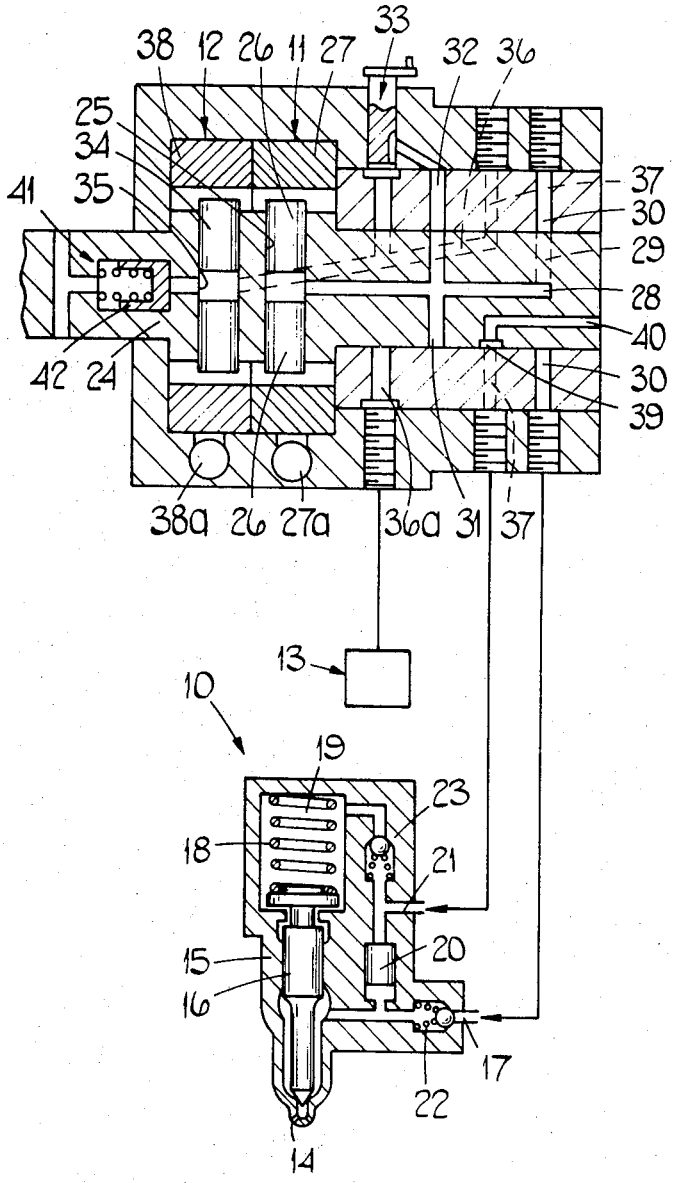
33
38
12
26
11
27
32
36
25
34
35
41
37
30
29
28
40
42
24
30
39
38a
26
27a
36a
31
37
13
10
19
23
18
21
15
20
16
17
22
14

FUEL SYSTEMS FOR INTERNAL COMBUSTION ENGINES

This invention relates to a fuel system for a multi-cylinder internal combustion engine and of the kind comprising a plurality of injection nozzles which in use, are mounted on an engine to direct fuel into respective combustion spaces of the engine, each nozzle incorporating a resiliently loaded valve member which controls the flow of fuel through an outlet from a fuel inlet, the valve member being operable by fuel under pressure supplied to the inlet, a fuel pump for supplying fuel to the inlets in turn and pilot pumps incorporated in the nozzles respectively and which when actuated cause a small volume of fuel to be delivered through the respective outlets in advance of the main volume of fuel.

A fuel injection nozzle incorporating a pilot pump is described in the specification of our pending British Application 19906/76. In this case the pilot pump is actuated by a stack of piezoelectric crystals or by an electromagnetic device including an armature and a solenoid. These two ways of driving the pilot pump require the fuel system to have associated therewith an electrical system. Moreover, it is necessary to provide on the injection nozzle an electrical connector. Other ways are mentioned in the specification of driving the pilot pump. One such way is by means of a mechanical drive from the engine but this does present practical difficulties. A further way is by pneumatic pressure which is generated by a pneumatic source driven by the engine. This also requires a connection to the injection nozzle. A third way is by means of engine cylinder pressure and whilst this may not require an external connection, a passage must be provided in the nozzle in communication with the engine cylinder. It is difficult with the last three ways mentioned to provide for variation in timing of delivery. A further problem with a fuel system of the kind described is the need to provide a pipe to convey fuel away from the nozzle which has leaked past the valve member. In each case, therefore, an additional connection must be provided on the nozzle and in the case where some form of additional connector is required for the purpose of driving the pilot pump, the additional connection to enable the fuel which has leaked past the valve member to be carried away, complicates installation of the nozzle and requires additional space on the nozzle.

The object of the present invention is to provide a fuel system of the kind specified in a simple and convenient form.

According to the invention, a fuel system of the kind specified comprises pilot inlets on the injection nozzles respectively, said pilot inlets, in use, receiving liquid under pressure in turn to actuate the respective pilot pumps, each nozzle incorporating a non-return valve disposed to allow fuel which has leaked past the respective member to flow to the respective pilot inlet when the liquid pressure at the pilot inlet is sufficiently low, the system including a pressure pump for supplying liquid under pressure to the pilot inlets in turn and means for connecting the pilot inlets to a drain during at least part of the time when liquid is not being delivered thereto whereby the fuel which has leaked past the valve member can flow by way of said non-return valve to the drain.

One example of a fuel system in accordance with the invention will now be described with reference to the accompanying diagrammatic drawing.

Referring to the drawing, an injection nozzle is indicated at 10, a fuel injection pump at 11 and a pressure pump at 12. Liquid fuel is supplied to both the injection pump and the pressure pump by means of a feed pump 13 which draws fuel from a convenient source.

Only one injection nozzle 10 is shown but it will be appreciated that there are as many injection nozzles as there are combustion spaces of the associated engine. Moreover, each injection nozzle incorporates an outlet 14 which, in use, is disposed to direct fuel into the respective combustion space of the associated engine. The nozzle includes a body 15 in which is slidably accommodated a valve member 16, the narrower end of which is adjacent the outlet 14 and is shaped to co-operate with a seating to control the flow of fuel from a main inlet 17 to the outlet 14. The valve member is loaded by a coiled compression spring 18 which is accommodate within a chamber 19 formed in the nozzle body. When fuel under pressure is supplied to the inlet 17 it acts upon the valve member 16 against the action of the spring 18 and when the fuel pressure is sufficient, the valve member is lifted from its seating to allow fuel flow through the outlet 14.

The nozzle also incorporates a pilot pump in the form of a plunger 20 movable within a cylinder. One end of the cylinder is connected to a point downstream of the inlet 17 whilst the other end of the cylinder is connected to a pilot inlet 21. Moreover, interposed between the inlet 17 and the connection to said one end of the cylinder accommodating the plunger 20, is a spring loaded non-return valve 22 disposed to permit passage of fuel through the inlet 17 but to prevent reverse flow. In use, when liquid under pressure, the liquid in this case being fuel, is supplied to the pilot inlet 21, the plunger 20 is moved towards said one end of its cylinder and the pressure of the displaced fuel is sufficient to lift the valve member 16 from its seating thereby to permit a pilot quantity of fuel to flow through the outlet 14. The plunger 20 is returned to said one end of its cylinder when the pressure at the pilot inlet 21 is reduced and during the time when fuel is supplied to the main inlet 17.

The nozzle also incorporates a further spring loaded non-return valve 23 which is disposed in a passage connecting the chamber 19 with the pilot inlet 21. The valve 23 is arranged to prevent the flow of fuel under pressure at the inlet 21 into the chamber 19. The valve 23 can however open to allow fuel to escape from the chamber 19 when the fuel pressure at the inlet 21 has been reduced by a sufficient amount. It is well known that in use fuel leaks past the working clearance between the valve member 16 and the wall of the bore in which it is located. This fuel collects in the chamber 19 and is allowed to escape therefrom under the conditions just described.

Fuel is supplied to the inlet 17 by an injection pump 11 which is of the well known rotary distributor type. The injection pump includes a rotary distributor member 24 which is driven in timed relationship with the associated engine. Formed in the distributor member is a transversely extending bore 25 which accommodates a pair of pumping plungers 26. The plungers are moved inwardly by the action of cam lobes formed on the internal peripheral surface of an annular cam ring 27. Moreover, the space defined between the plungers 26 communicates with a longitudinal bore 28 formed in the distributor member and which at one point communicates with a radially disposed delivery passage 29. The passage 29 registers in turn, as the distributor member rotates, with a plurality of outlets 30 which are connected to the respective inlets 17 of the injection nozzles.

The longitudinal passage 28 also communicates with a plurality of fuel inlet passages 31 and these can register in turn with an inlet port 32 which communicates with the outlet of the feed pump 13 by way of an adjustable throttle 33. The throttle 33 controls the amount of fuel which is supplied to the space between the plungers 26 when an inlet passage 31 communicates with the inlet port 32. During such communication the delivery passage 29 is out of communication with the outlets 30 but as the distributor member rotates, the inlet passage 31 is moved out of register with the inlet port 32 and the delivery passage 29 is moved into register with an outlet 30. Inward movement of the plungers then takes place and fuel is delivered to the inlet 17 of the injection nozzle. The amount of fuel delivered depends upon the setting of the throttle member 33.

The pressure pump 12 is also provided with a pair of plungers 34 accommodated within a further transversely disposed bore 35 formed in the distributor member. The bore 35 communicates with a passage 36 which communicates with a pilot supply passage extending to the periphery of the distributor member and which can register in turn with a plurality of pilot outlets 37 which are connected to the pilot inlets 21 respectively.

The passage 36 includes a branch passage through which fuel can be supplied to the pressure pump, the branch passage being brought into register with fuel inlets **36*a*** at the appropriate time.

The plungers 34 are movable inwardly by cam lobes formed on the peripheral surface of an annular cam ring 38 and it is arranged that the inward movement of the plungers 34 takes place just before the inward movement of the plungers 26. When inward movement of the plungers 34 takes place, fuel under pressure is supplied to a pilot inlet 21 in advance of the supply of fuel to the inlet 17 of the same nozzle.

In order to reduce the pressure at the pilot inlets 21, when fuel is not being supplied thereto, the distributor member 24 is provided with a circumferentially extending groove 39 which communicates with a drain by way of a drain passage 40 formed in the distributor member. The ends of the circumferential groove are spaced from the pilot supply passage which communicates with the passage 36. In this manner the outlets 37 which are not about to or have just received fuel, are in communication with the drain thereby allowing any fuel which has collected in the respective chambers 19 to flow past the respective non-return valve 23 to the drain.

It is arranged that the pressure pump 12 delivers more fuel than is required to displace the plunger 20 between the ends of its cylinder. The surplus fuel is stored in a variable volume reservoir generally indicated at 41. The reservoir includes a piston member 42 which is biased by means of a spring. The piston member 42 is accommodated within a cylinder one end of which communicates with the transversely extending bore 35 and the other end of which communicates with the interior of the housing of the pump. In view of the fact that the pressure pump supplies an excess of fuel, the plunger 20 will always be moved its maximum extent within the cylinder and therefore, the quantity of fuel which is delivered in advance of the main quantity of fuel, is fixed. The timing of delivery of this fuel may however be adjusted by varying the angular position of the cam ring 38 by means **38*a*. Since the cam ring 27 will normally be angularly adjustable by means 27*a* to vary the timing of delivery of fuel, the cam ring 38 must also be moved angularly with the cam 27**. However, the two cam rings may be moved relative to each other to adjust the timing of delivery of the pilot quantity of fuel in relation to the main quantity of fuel in relation to the main quantity of fuel.

By the arrangement described above, it is possible to vary the relative timing of delivery of the pilot quantity of fuel and the main quantity of fuel. Moreover, each nozzle requires only two connections to be made thereto which greatly simplifies the installation of the system on an engine.

I claim:

1. A fuel system for a multi-cylinder internal combustion engine comprising a plurality of injection nozzles which in use are mounted on an engine to direct fuel into respective combustion spaces of the engine, each nozzle incorporating a resiliently loaded valve member which controls the flow of fuel through an outlet from a fuel inlet, the valve member being operable by fuel under pressure supplied to the inlet, a fuel pump for supplying fuel to the inlets in turn, pilot pumps incorporated in the nozzles respectively and which when actuated cause a small volume of fuel to be delivered through the respective outlets in advance of the main volume of fuel, pilot inlets on the injection nozzles respectively, said pilot inlets, in use, receiving liquid under pressure in turn to actuate the respective pilot pumps, each nozzle incorporating a non-return valve disposed to allow fuel which has leaked past the respective valve member to flow to the respective pilot inlet when the liquid pressure at the pilot inlet is sufficiently low, the system including a pressure pump for supplying liquid under pressure to the pilot inlets in turn and means for connecting the pilot inlets to a drain during at least part of the time when liquid is not being delivered thereto whereby the fuel which has leaked past the valve member can flow by way of said non-return valve to the drain.

2. A fuel system according to claim 1 in which the pilot pumps of each nozzle comprise a cylinder formed in a body of the nozzle, a plunger slidable within said cylinder, one end of the cylinder communicating with a passage extending between the fuel inlet and the valve member, and the other end of the cylinder communicating with the pilot inlet.

3. A fuel system according to claim 2 in which each nozzle includes a further non-return valve disposed in said passage downstream of the fuel inlet but upstream of the connection with said one end of the cylinder, said further non-return valve acting to allow fuel flow through said fuel inlet from the fuel pump but to prevent flow in the reverse direction.

4. A fuel system according to claim 3 in which said fuel pump and said pressure pump are housed in a common housing, a rotary distributor member in said housing, first and second passages extending to the periphery of the distributor member in a communication with the fuel pump and pressure pump respectively, a first series of outlets in the common housing, said first passage registering in turn with the outlets of said first series of outlets during successive fuel deliveries by the fuel pump, the outlets of said first series of outlets being connected to the fuel inlets of the nozzles respectively and a second series of outlets in the common housing, said second passage registering in turn with the outlets of said second series of outlets during successive deliveries by the pressure pump, the outlets of said second series being connected to the pilot inlets of the nozzles respectively.

5. A fuel system according to claim 4 including a circumferentially extending groove on the distributor member, passage means through which said groove is connected to a drain, the ends of said groove being spaced from each other by a portion of the surface of the distributor member, said second passage extending to the periphery of the distributor intermediate the ends of said groove whereby with the exception of the one outlet of said second series of outlets which is in communication with the second passage, the outlets of said second series of outlets will communicate with said drain through said passage means.

6. A fuel system according to claim 5 in which the fuel pump and pressure pump have rotary parts carried by said distributor member and fixed parts which are adjustably mounted in the common housing, said fixed parts being relatively adjustable to vary the interval between delivery of fuel by the pilot pumps and the delivery of fuel through the nozzles by the fuel pump.

7. A fuel system according to claim 6 in which said fixed parts comprise a pair of annular cam rings respectively and said rotary parts comprise pairs of plungers located in bores formed in the distributor member.

* * * * *